US007322134B2

(12) United States Patent
Cheek et al.

(10) Patent No.: US 7,322,134 B2
(45) Date of Patent: Jan. 29, 2008

(54) GREETING CARDS, POSTCARDS, GIFT BAGS, AND THE LIKE EMPLOYING A SPECIAL EFFECTS CONTAINER

(75) Inventors: Maria Cheek, Roswell, GA (US); Jean Leigh, Roswell, GA (US); Jeffrey D. Mullen, Scarsdale, NY (US)

(73) Assignee: Anderson Press, Inc., Atlanta, GA (US)

( * ) Notice: Subject to any disclaimer, the term of this patent is extended or adjusted under 35 U.S.C. 154(b) by 0 days.

(21) Appl. No.: 10/618,300

(22) Filed: Jul. 11, 2003

(65) Prior Publication Data

US 2004/0128876 A1 Jul. 8, 2004

Related U.S. Application Data

(60) Provisional application No. 60/397,564, filed on Jul. 19, 2002.

(51) Int. Cl.
*G09F 1/00* (2006.01)

(52) U.S. Cl. ..... 40/124.12; 40/124.06; 40/124.11; 40/409

(58) Field of Classification Search ..... 40/124.01, 40/124.06, 124.09, 124.11, 124.12, 406, 409, 40/410; 283/117; 446/147, 149, 267; 229/72, 229/92.8; 206/462
See application file for complete search history.

(56) References Cited

U.S. PATENT DOCUMENTS 1,180,618 A 4/1916 Stirn
3,191,340 A * 6/1965 Jacobson et al. ..... 446/149
3,321,860 A 5/1967 Dichtl et al.
4,584,213 A 4/1986 Rentowl
4,787,160 A * 11/1988 Balsamo ..... 40/124.12
4,840,275 A 6/1989 Faiola et al.
4,841,651 A 6/1989 Conner
4,870,764 A * 10/1989 Boone ..... 40/124.06
D304,459 S 11/1989 Lambert
4,890,402 A 1/1990 Carroll
4,951,404 A 8/1990 Lithwick
D312,655 S 12/1990 Faiola et al.
5,195,918 A * 3/1993 Mozes ..... 446/227
5,197,213 A * 3/1993 Borden ..... 40/737
5,218,774 A * 6/1993 Mullins ..... 40/722
5,289,917 A * 3/1994 Chabria ..... 206/232
5,303,487 A * 4/1994 Olson ..... 40/124.12
5,377,836 A 1/1995 Eisenbraun
5,407,076 A 4/1995 Sabet
5,607,101 A * 3/1997 Saito ..... 229/71

(Continued)

*Primary Examiner*—Joanne Silbermann
(74) *Attorney, Agent, or Firm*—Ropes & Gray LLP

(57) ABSTRACT

Special effects containers that include a special effects substance are provided in, for example, greeting cards, gift bags, photo albums, postcards. This substance may comprise particles (e.g., a glitter or confetti) and a liquid (e.g., water) such that when the special effects container is shaken, a visual effect is produced. One type of visual effect produced is similar to that of a snow globe. For example, pieces of a polymer confetti, each having the shape of a snowflake, may be included in a special effects container with a liquid. Such confetti may have a negative buoyancy with respect to the liquid such that after the special effects container is shaken, the pieces of confetti sink. The rate of descent/ascent of the container particles can be configured by changing the specific weight of the liquid or particles.

48 Claims, 10 Drawing Sheets

U.S. PATENT DOCUMENTS 5,670,219 A 9/1997 Na
5,782,357 A 7/1998 Johnson
6,151,823 A * 11/2000 Gregory-Gillman ..... 40/661
6,230,425 B1 5/2001 Ellison
D455,781 S 4/2002 Jobelius et al.
6,438,878 B1 * 8/2002 Fine et al. ..... 40/409
6,449,891 B1 * 9/2002 Miska ..... 40/789
6,484,425 B1 * 11/2002 Hirsch ..... 40/406
6,718,676 B2 * 4/2004 Miska ..... 40/789

* cited by examiner

GREETING CARDS, POSTCARDS, GIFT BAGS, AND THE LIKE EMPLOYING A SPECIAL EFFECTS CONTAINER

CROSS REFERENCE TO RELATED APPLICATION

This application claims the benefit of U.S. Provisional Patent Application No. 60/397,564 filed Jul. 19, 2002, which is hereby incorporated by reference herein in its entirety.

BACKGROUND OF THE INVENTION

Greeting cards containing pre-printed messages are well known in the art. Such greeting cards usually take the form of a folded piece of paper, cardboard, or other paper stock that can be inserted into an envelope and mailed. These greeting cards may be have a theme (e.g., Christmas) and, accordingly, may contain theme associated pre-printed text or messages (e.g., Merry Christmas) and indicia (e.g., a snowman). When included in a greeting card, such themed indicia and pre-printed information increases the greeting card's whimsical and festive nature by increasing the functionality of the greeting card in certain circumstances (e.g., Christmas). However, current greeting cards are deficient because the whimsical and festive nature of the greeting card is determined solely by the indicia and pre-printed information of that greeting card. It would be therefore by desirable to further improve the whimsical and festive nature of a greeting card.

SUMMARY OF THE INVENTION

It is therefore an object of the present invention to improve the whimsical and festive nature of a greeting card, gift bag, postcard, or the like by including structures that increase the utility of a greeting card, gift bag, postcard, or the like.

A greeting card is provided that includes a special effects container filled with a substance. This substance may comprise, for example, a confetti, glitter, liquid, the like, or any combination thereof. When shaken or manipulated, the substance creates a visual effect that increases the whimsical and festive of the greeting card. The principles of this invention may also be incorporated into postcards, gift bags, photo albums, or the like.

In one embodiment, a circular special effects container is included on a greeting card. This special effects container is filled with a substance comprising multiple container particles (e.g., a confetti or glitter) such that when the card is shaken, the container particles move throughout the container. If, for example, a confetti is used then the visual effect realized is similar to the visual effect produced by falling confetti. The functionality of traditional confetti is lost after a user throws the confetti. However, because the confetti of the present invention is housed in a special effects container, a user can enjoy the visual effect of throwing confetti any time the user shakes the greeting card. The greeting card container may also be opened by a user so that the confetti may be thrown in the traditional manner.

As per another embodiment of the present invention, a greeting card may include a container that houses a substance comprising not only container particles (e.g., glitter) but also, for example, a liquid (e.g., colored water). The container particles may have a certain buoyancy with respect to the liquid such that the container particles either float or sink in the liquid after the special effects container is shaken.

For example, suppose that the substance comprises container particles and a liquid. Now, if these container particles are included as confetti that resembles snow, and these particles have negative buoyancy with respect to the liquid then the visual effect produced from shaking the greeting card may resemble the effect from a recently shaken snow globe. Alternatively, suppose, for example, that the container particles resemble bubbles, and these particles have a positive buoyancy with respect to the liquid then the visual effect produced from shaking the greeting card may resemble a bubbling effect.

BRIEF DESCRIPTIONS OF THE INVENTION

The above-mentioned objects and features of the present invention can be more clearly understood from the following detailed description considered in conjunction with the following drawings, in which the same reference numerals denote the same structural elements throughout, and in which.

DETAILED DESCRIPTION OF THE INVENTION

Figure 1:
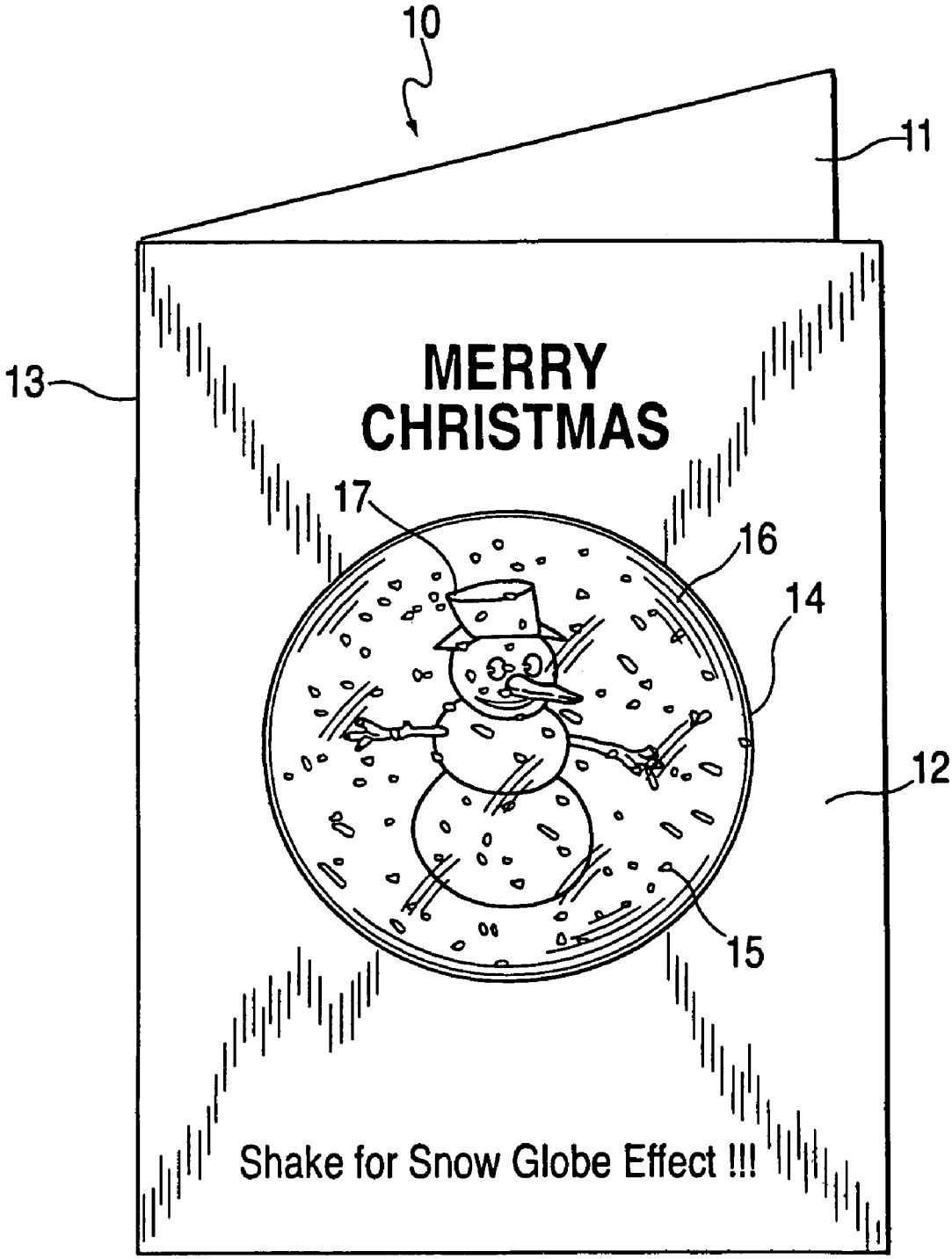
FIG. 1 is an exterior view of a greeting card employing a visual effects container.

FIG. 1 is an exterior view of greeting card 10 constructed in accordance with the principles of the present invention. Greeting card 10 includes sheet segments 11 and 12 that are defined by fold line 13. Preferably, greeting card 10 is constructed from a sheet of paper, cardstock, or any other suitable greeting card medium. Instead of folding a sheet in half to define sheet segments 11 and 12 and construct greeting card 10, two separate sheet segments may be attached together and folded at the point of attachment. Unattached sheet segments may be bonded together, for example, with tape, glue, staples, string (through punch-holes), or any other type of adhesive or bonding device.

Greeting card 10 includes special effects container 14 that holds substance 15. Container 14 may be constructed in several ways. For example, container 15 may be constructed, in part, by affixing transparent containment sheet 16 to the interior of sheet segment 12. Such a transparent containment sheet could be a sheet of any type of transparent or semi transparent polymer or non-polymer. Containment sheet 16 may have a colored tint in order to, for example, give substance 15 the illusion of having a color. For example, to visually replicate blue water, a blue tinted transparent containment sheet may be employed instead of including a blue liquid in substance 15.

A shape (e.g., a circle as shown in FIG. 1) may be cut out of sheet segment 12 to form an aperture or viewing window against transparent containment sheet 16. Substance 15 may be selectively laid on transparent containment sheet 16 so that substance 15 is aligned with the viewing window of sheet segment 12. A second containment sheet (not shown) may be affixed to the back of containment sheet 16 so that substance 15 is sealed between containment sheet 16 and this second containment sheet.

Image 17 may be placed on a containment sheet. Preferably, image 17 is included on the second containment sheet (not shown) such that substance 15 is located in front of image 17 (from the perspective of the front exterior of greeting card 10). This second containment sheet may also be included as a third sheet segment formed by a third fold line (as shown in greeting card 20 of FIG. 2). To construct a postcard, sheet segment 11 may either be removed from greeting card 10 or not provided at all. Image 17 may be printed on, aligned with, or pasted on the container or any other part of greeting card 10. Preferably, image 17 will viewable on the second containment sheet. In doing so, the visual effect may occur in front of image 17, thus manipulating a user's perspective of image 17. For example, suppose that image 17 is a snowman and that this image is placed on the second containment sheet. Now, suppose that substance 15 includes water and a non-buoyant confetti that resembles snow. In this example, if greeting card 10 is shaken by a user then the user will see the illusion of snow falling in front of and on the snowman.

Persons skilled in the art will appreciate that greeting card 10 may be modified such that substance 15 can move more freely inside of the container. In doing so, a variety of different visual effects may be created. For example, if the volume of space inside container 14 is increased, substance 14 will have more space to move around in. Volume may be increased, for example, by introducing lag between the containment sheets defining the container. As per another example, an additional spacing sheet (not shown) may be placed between the two containment sheets. Such a spacing sheet preferably has an aperture similar to the aperture of sheet 12 such that the spacing sheet is not visibly noticed in the container by the user. In adding a spacing sheet, additional volume is provided that is proportional to the thickness of this spacing sheet and the area of the shape of the aperture of sheet 12.

Substance 15 of greeting card 10 may include, for example, both a liquid (e.g., water) and non-buoyant container particles (e.g., snow glitter or confetti) with respect to that liquid. Thus, when a user shakes greeting card 10, the container particles will scatter in the container and descend with gravity. The container particles may be employed to descend in liquid 15 at different speeds depending by employing container particles, or the liquid itself, with particular specific weights. In including substance 15 as a liquid with non-buoyant particles that resemble snow in greeting card 10, a snow globe is included in greeting card 10.

However, if substance 15 includes a buoyant container particle and a liquid and greeting card 10 is shaken the buoyant container particle will rise in the liquid when the shaking stops. Such a substance 15 would produce, for example, a bubbling visual effect in greeting card 10 when greeting card 10 is shaken.

Greeting card 10 may include a sleeve that is aligned with the container in which a photograph, drawing, or the like may be placed. Thus, a user can use the visual effects created in the container to manipulate any desired photograph, drawing, or the like. For example, suppose that both container sheets are transparent. A sleeve may be attached to the second (e.g, rear) container sheet in which a wallet size photograph may be inserted. As a result, a user may, before mailing greeting card 10 to a relative, put a wallet size photograph of himself or herself in this sleeve. When the greeting card is received by this relative and shaken, the appearance of the inserted photograph will change according to the produced visual effect.

Figure 2:
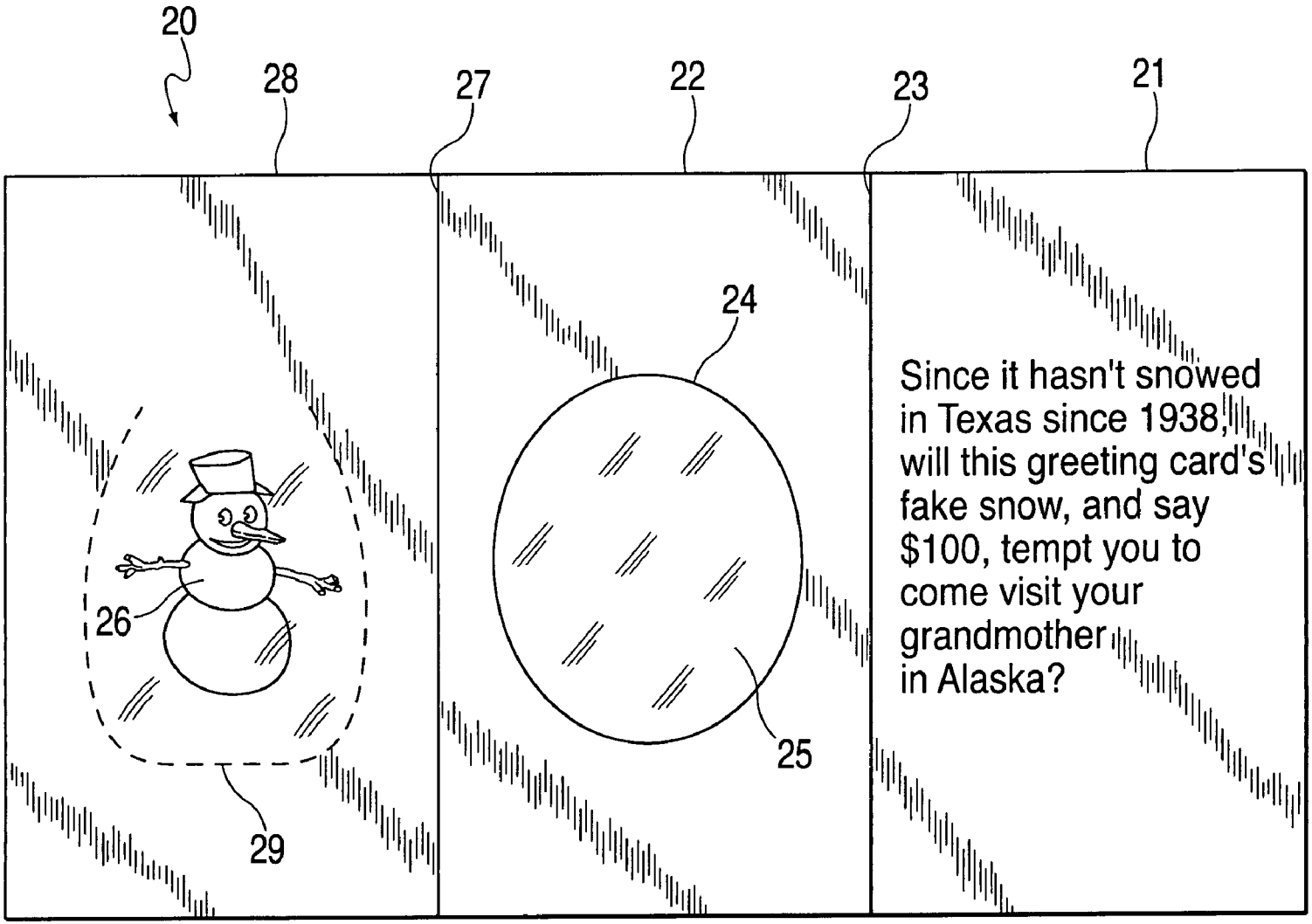
FIG. 2 is an interior view of a partially constructed greeting card employing a visual effects container.

Greeting card 10 and container 14 may be fabricated in a variety of ways. For example, additional fold lines and additional sheet segments may be incorporated into greeting card 10. FIG. 2 is an interior view of an partially constructed greeting card 20 that advantageously employs a second fold line to create a three sheet segment. More particularly, greeting card 20 includes fold lines 27 and 23 that define sheet segments 21, 22, and 28.

Located on sheet segment 22 is aperture 24. Transparent containment sheet 25 is affixed to sheet 22 to form the front of a visual effects container. Either sheet segment 28 or sheet segment 21 may be folded over fold line 27 or fold line 23, respectively, and affixed to sheet segment 22 in order to form the rear portion of the container. Preferably, sheet segment 28 is folded over fold line 27 and affixed to sheet segment 22. Before the two sheet segments are affixed, however, a visual effect substance is preferably placed between the two sheet segments. Sheet segment 28 may be affixed to sheet segment 22 around the perimeter of sheet segment 22 or, for example, the perimeter of aperture 24. However, a visual effect substance may be concentrated on containment sheet 25 if the visual effect substance is placed on containment sheet 25 and contained therein by affixing sheet segment 22 around the perimeter of aperture 22.

If the visual effect substance includes a liquid then sheet 28 may first be attached to sheet 22 around, for example, line 29 in order to form a pouch. The liquid may be poured into the pouch and then the pouch may be sealed to form a container. In such an embodiment, sheets 28, 22, or transparent containment sheet 25 may be water resistant and attached to form a water-tight seal.

Alternatively, a liquid-based special effect substance may be placed in a water-tight container instead of forming a container out of sheets 28 and 25. This container may then simply be attached (e.g., glued) to a portion of greeting card 20 (e.g., exterior side of sheet 22 when greeting card 20 is closed). For example, a liquid may be poured into a plastic bag. After this bag is sealed, the bad may simple be attached to greeting card 20.

Persons skilled in the art will appreciate that indicia 26 and/or descriptive writing may be included on the sheet segment 28 or any other portion of greeting card 20. Indicia 26 may be positioned on sheet segment 28 so that when sheet segment 28 is folded over fold line 27 and affixed to sheet segment 22, indicia 26 is visible through transparent shield 25 from the exterior of greeting card 20.

Figure 3:
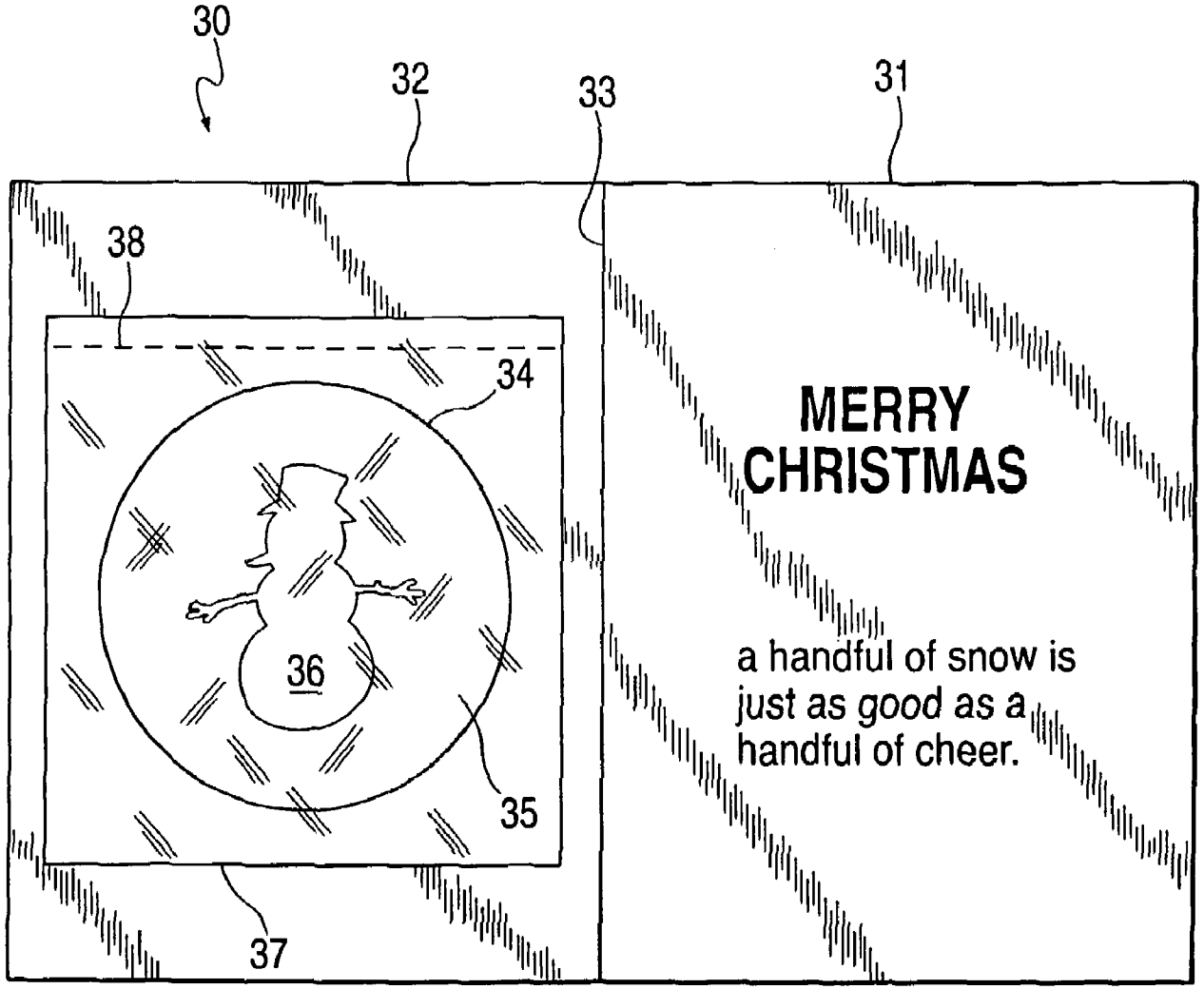
FIG. 3 is an interior view of a greeting card employing a visual effects container.

FIG. 3 is an exterior view of greeting card 30 with a single fold line (e.g., fold line 33) that defines two sheet segments (e.g., sheet segments 31 and 32). If only two sheet segments are included on a greeting card of the present invention before it is fully constructed, container 35 preferable will not be formed by affixing sheet segments 32 and 31 together. However, in affixing sheet segments 21 and 32 together a postcard would be created. Having a postcard with the visual effects capabilities in accordance with the principles of the present invention may be beneficial. Examples of such postcards may be found in FIGS. 9 and 10.

Different schemes may be utilized to fabricate a variety of different container 35 structures on greeting card 30. One such scheme may create container 35 by affixing second containment sheet 37 to sheet segment 32. In this embodiment, second containment sheet 37 forms the rear of container 35. Second containment sheet 37 may be transparent and may include image 36. Second containment sheet 37 may be affixed to sheet segment 32, for example, in the area outside the perimeter of aperture 34 and the perimeter of containment sheet 37. Containment sheet 37 may alternatively be affixed to sheet segment 32 around the perimeter of containment sheet 37. Perforation 38 may be included on containment sheet 37 such that a user can remove the special effect substance from container 35. This perforation may be re-sealable such that a user can add a special effect substance to container 35.

Figure 4:
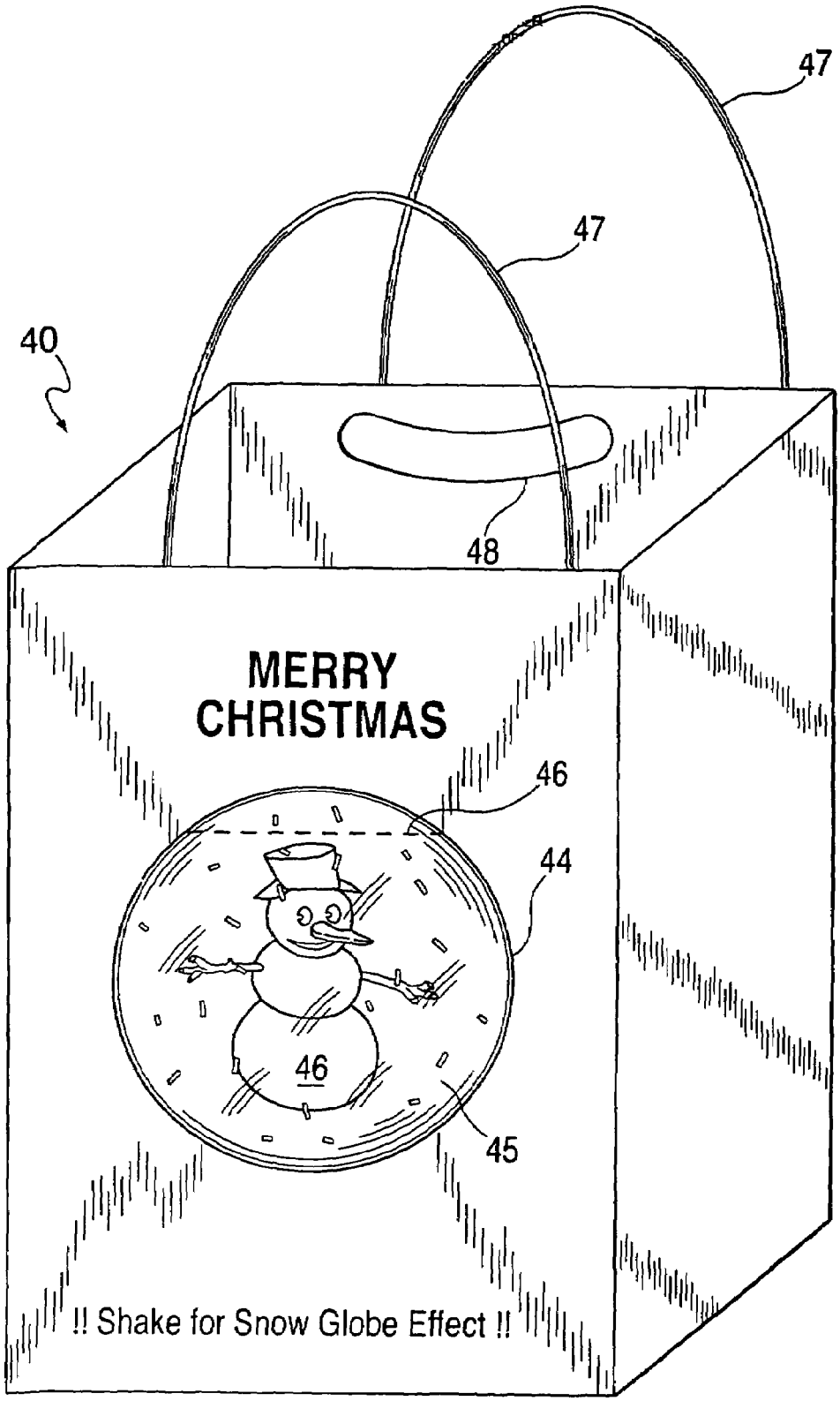
FIG. 4 is an exterior view of a gift bag employing a visual effects container.

FIG. 4 is an exterior view of gift bag 40 that includes visual effects container 44. Similar to the other visual effects container (e.g., container 35 of FIG. 3) discussed herein, container 44 includes substance 45 that, when shaken, creates a visual effect (e.g., a snow globe effect). Indicia 46 may also be included on gift bag 40. Container 44 may be constructed separate from gift bag 40. This container may be formed, for example, by two sheets (e.g., two transparent sheets) or one transparent sheet folded in half. The container may originally start off as a water-tight pouch such that a liquid may be poured into the pouch. The pouch may then be sealed to form container 44. Alternatively, the pouch may contain a tear line (e.g., perforation 46) such that a user may open the container and use the special effect substance. This may be beneficial, for example, at a birthday party if the special effect substance includes confetti that a user would like to throw.

An aperture may be cut into gift bag 40. Special effects container 44 may then be aligned with this aperture and attached to gift bag 40 from, for example, the interior of gift bag 40. Gift bag 40 may be formed, for example, from one or more sheets of paper. One or more handles 47 may be attached to gift bag 40 such that a user can easily carry gift bag 40. Both handles 47 may be, for example, constructed from a single rope strung through apertures (not shown) in gift bag 40. Alternatively, handles that improve a user's grip on gift bag 40 may also take the form of apertures (e.g., aperture 48).

Figure 5:
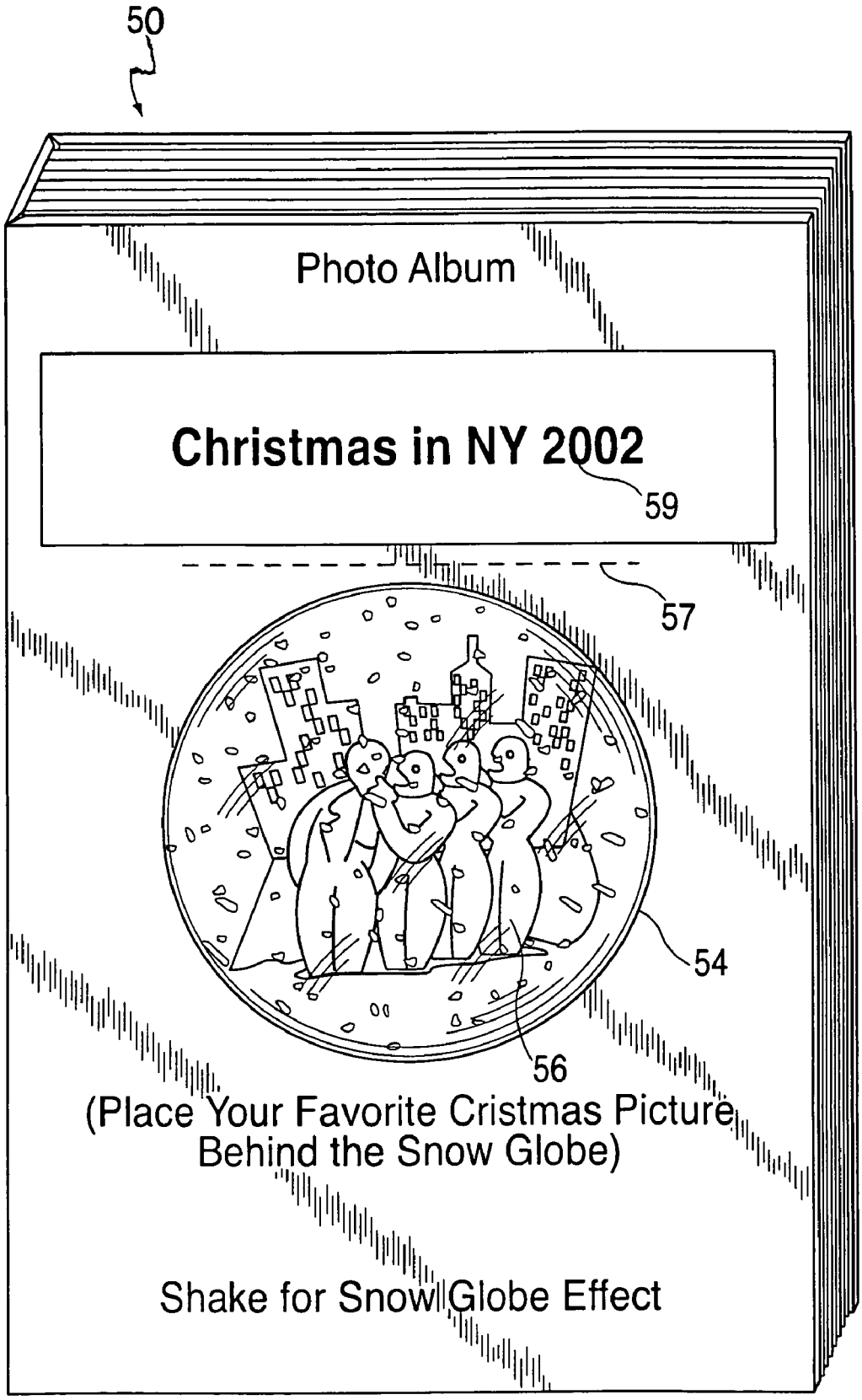
FIG. 5 is an exterior view of a photo album employing a visual effects container.

FIG. 5 is an exterior view of photo album 40 that includes visual effects container 54. Similar to other visual effects containers (e.g, a snow globe container) discussed herein, container 54 contains substance 55 that, when shaken, creates a visual effect (e.g., a snow globe effect). In order to increase the functionality of photo album 40, photograph or drawing 56 may be placed behind or in container 54. In adding photograph or drawing 56, the whimsical and festive nature of photo album 50 may be increased because a user would then be able to create a visual effect over a changeable photograph or drawing 56. Persons skilled in the art will appreciate that the functionality of allowing a user create a visual effect on a photograph or drawing may be used in other structured employing a visual effects container. For example, the functionality of a removable photograph, drawing, or the like may be included in a greeting card or gift bag of the present invention. Slit 57 may be included on the interior or exterior of book 50 and configured such that when picture 56 is placed in slit 57, picture 56 appears behind container 54. Persons skilled in the art will appreciate that similar special effects containers may also be included on the interior pages of the photo album.

Figure 6:
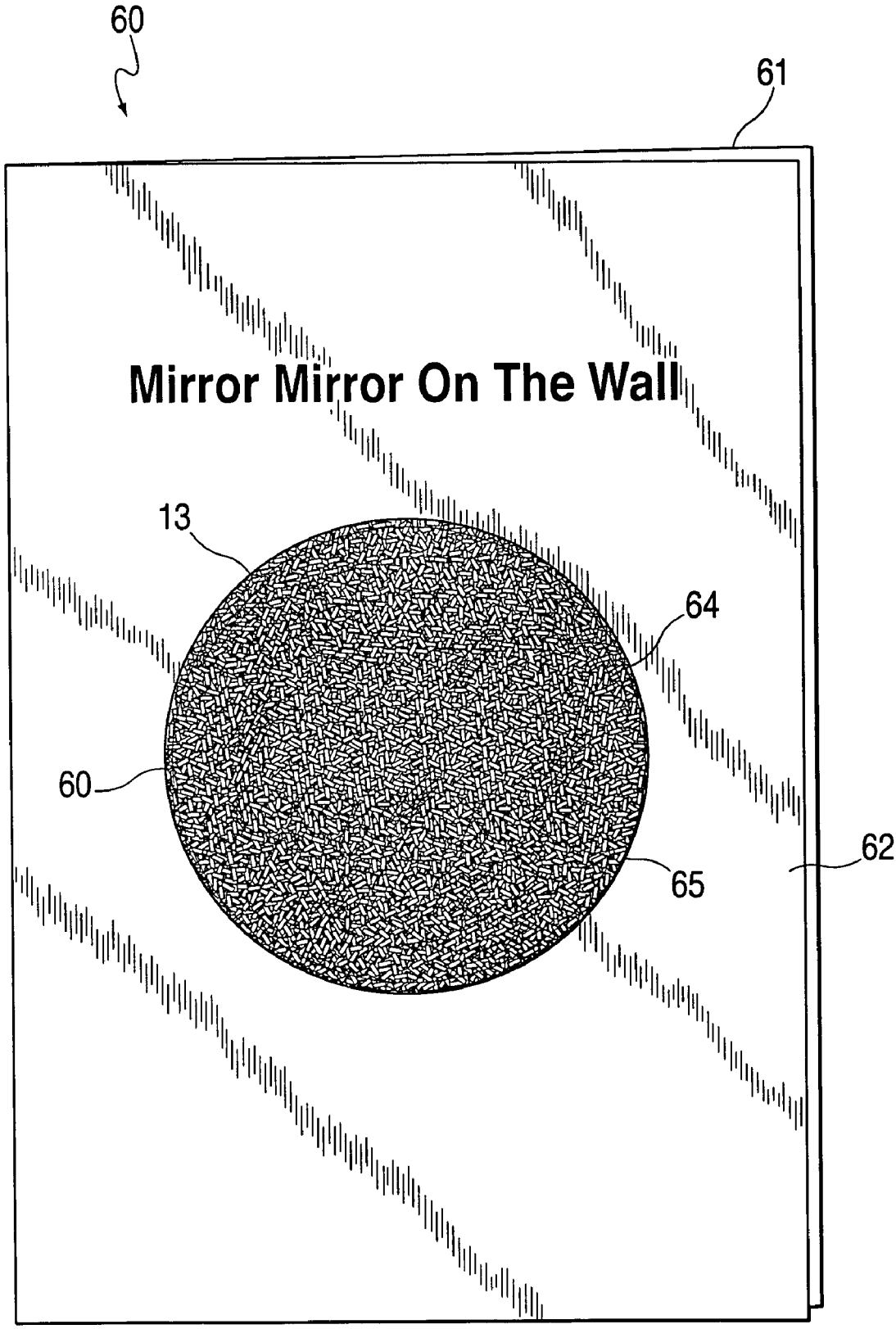
FIG. 6 is an exterior view of a closed magnetic filament filled visual effects container employed in a greeting card.
Figure 7:
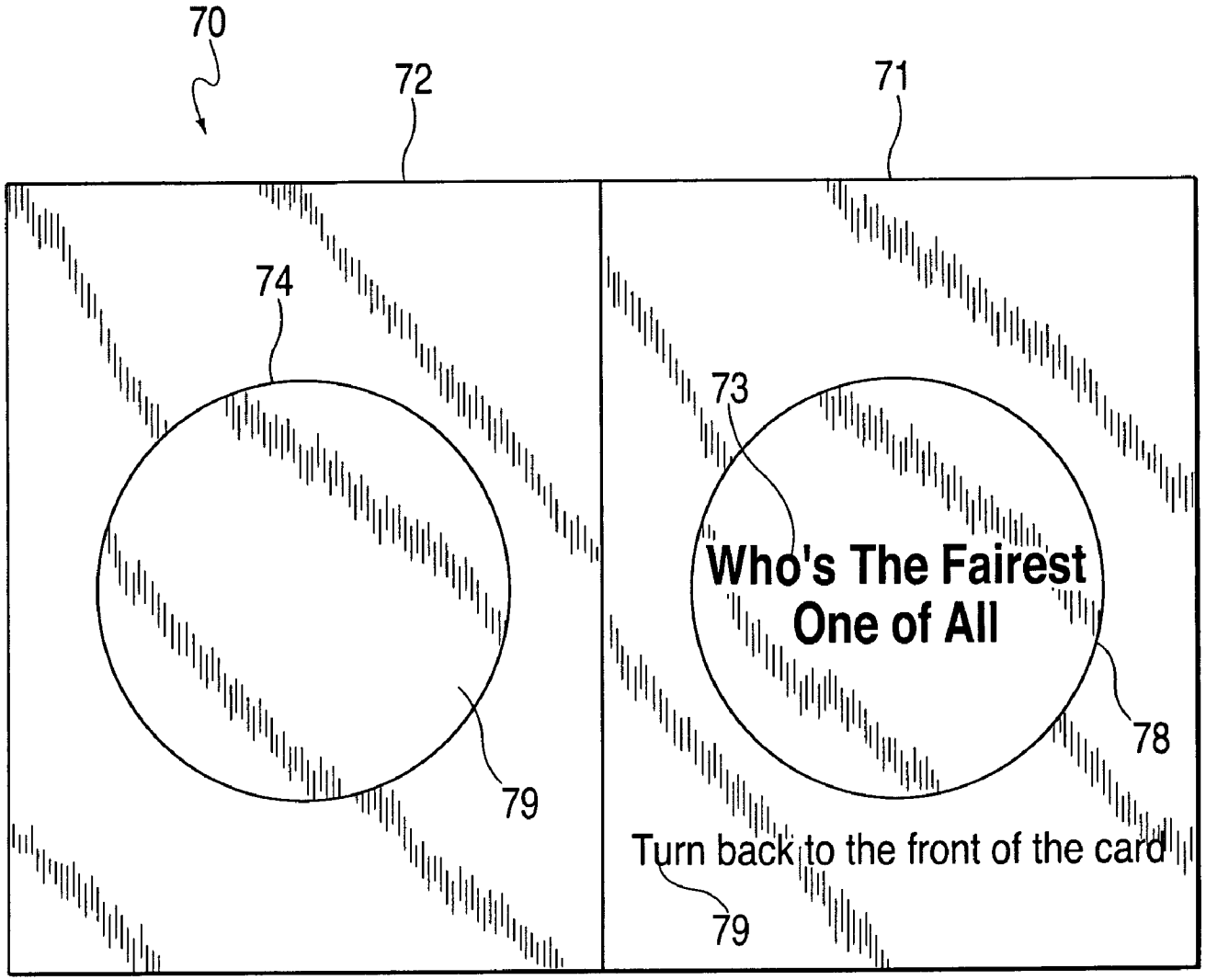
FIG. 7 is an interior view of a magnetic filament filled visual effects container employed in a greeting card.
Figure 8:
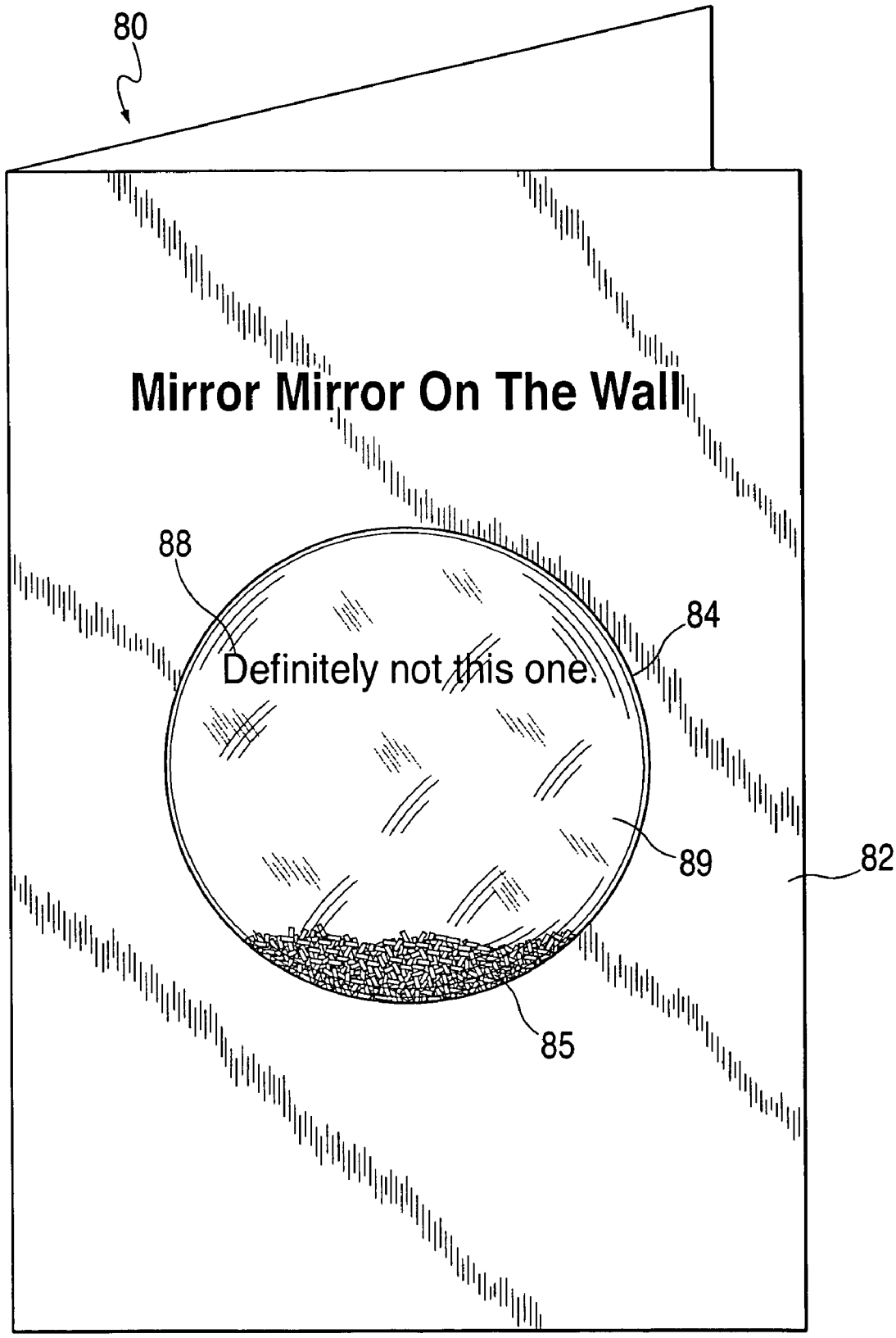
FIG. 8 is an exterior opened view of a magnetic filament filled visual effects container employed in a greeting card.

Many types of visual effects may be created by a visual effects container in accordance with the principles of the present invention. FIGS. 6-7 illustrate how a "wipe" visual effect may be realized in a greeting card.

Greeting card 60 may be, for example, a two sheet segment greeting card (sheet segments 61 and 62) defined by fold line 63. If a magnet is placed behind container 64 on sheet segment 61 and substance 65 contains magnetic filaments then the magnetic filaments will be attracted to the magnet when greeting card 60 is closed. If the magnetic filaments are evenly distributed in container 64 when card 60 is closed, and these magnetic filaments are thick or plentiful enough, then a user may not be able to see an image printed on the rear of container 64 (e.g., on a second containment sheet of container 64) or, if container 64 is transparent, an image printed on sheet segment 71.

However, when greeting card 60 is opened, the magnetic filaments will preferably no longer be attracted to the magnet and the magnetic filaments will fall with gravity. By opening the greeting card, the rear of container 24 (or, in transparent container embodiments, the interior of sheet segment 61) is made visible to a user. Thus, a wipe effect is produced from the falling magnetic filaments.

Greeting card 70 of FIG. 7 is one embodiment of greeting card 60 of FIG. 6 in an open position where the interior of sheet segments 71 and 72 are shown. The rear of container 74 includes a non-transparent containment sheet 74. Particularly, non-transparent containment sheet 74 is the non-reflective side of a mirror (the reflective side of the mirror is facing towards the exterior of sheet segment 72). Additionally, the non-reflective side of mirror 79 may be the same color as sheet segment 72 and may not exhibit any reflecting properties.

Magnet 78 is included on sheet segment 71. Initially, greeting card 70 is closed and container 74 includes magnetic filaments that are attracted to magnet 74. Preferably, these magnetic filaments (e.g., the special effects substance) cover the reflective side of mirror 79 such that a user is unaware of the presence of mirror 79. Thus, when a user opens greeting card 70, the user will see indicia 73 and 79. When the user closes the greeting card again to view the exterior of sheet segment 72, the magnetic filaments will have already fallen to the bottom of container 74 and the reflective side of mirror 79 will be visible to the user. An example of this functionality is included in greeting card 80 of FIG. 9 where magnetic filaments 85 have fallen to the bottom of container 84 revealing mirror 89 and indicia 88 on sheet segment 82.

Figure 9:
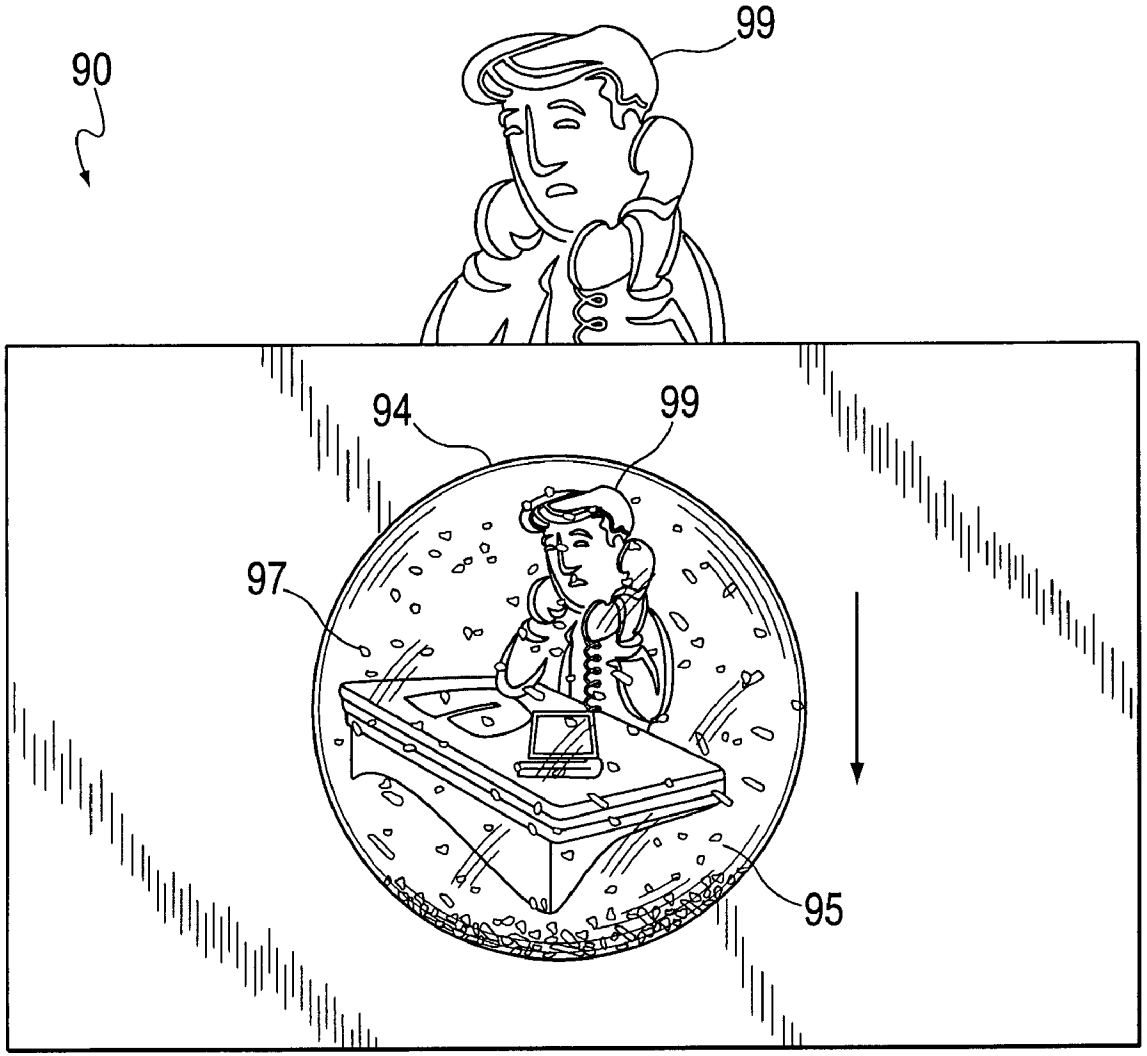
FIG. 9 is an frontal view of a postcard with a circular transparent visual effects container employed in a postcard.

FIG. 9 shows a front perspective of postcard 90 that includes a substantially circular visual effects container 94. Visual effects container 92 may be transparent so that a user that holds postcard 90 to object 99 can see object 99 through postcard 99. Thus, a user can create a visual effect on object 99 by a visual effect in container 94. As illustrated, container 94 includes substance 95 that, in turn, includes non-buoyant glitter/confetti and a liquid. Thus, when a user shakes postcard 90 in front of 95, a special effect (e.g., snow falling) may appear around object 95. Persons skilled in the art will appreciate that only one side of container 94 may be transparent. In this manner, an image may be placed on the non-transparent portion of container 94 such that the special effect occurs around that image.

Figure 10:
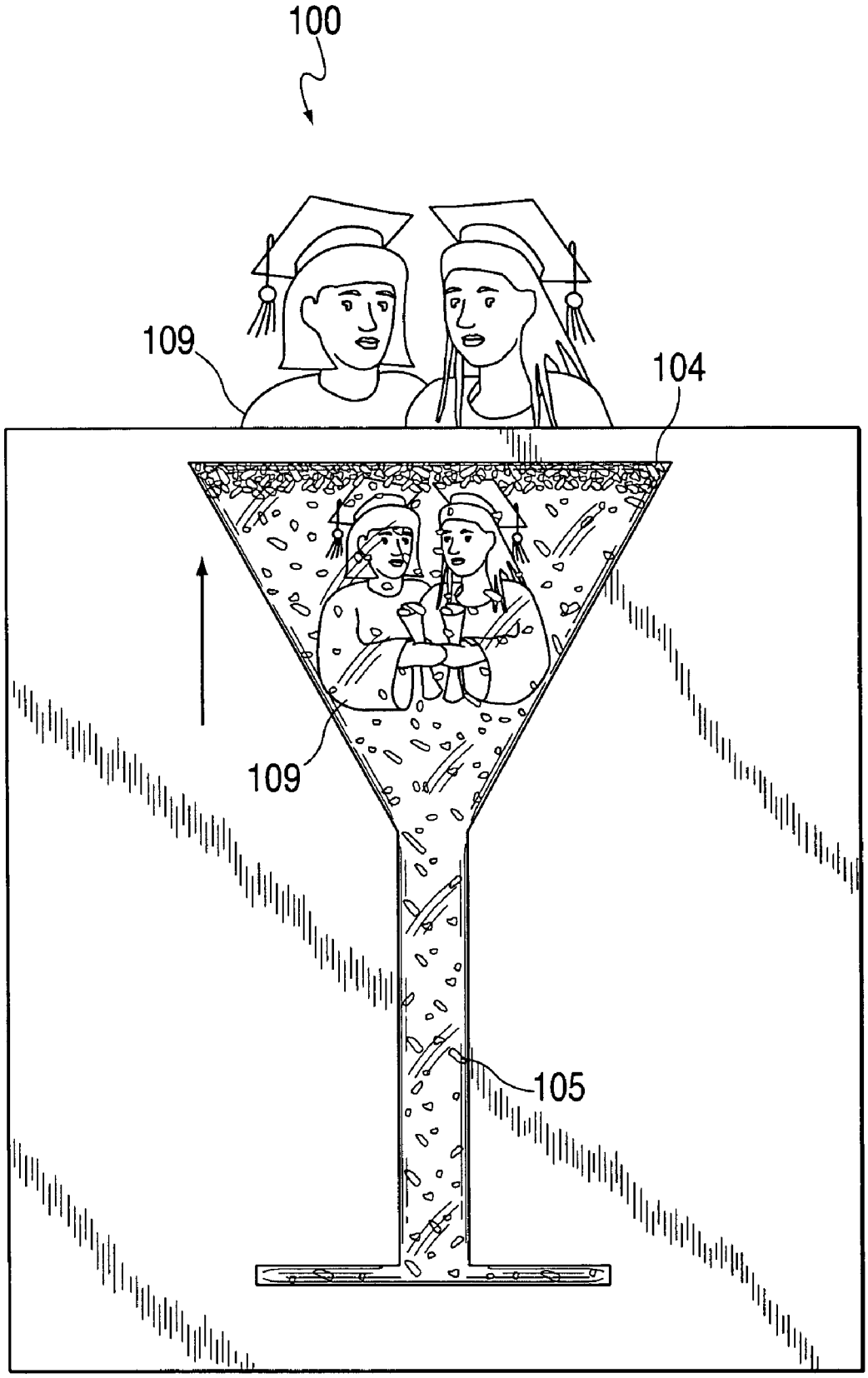
FIG. 10 is an frontal view of a postcard with a non-circular transparent visual effects container employed in a postcard.

FIG. 10 is a frontal view of postcard 100 that includes a substantially non-circular visual effects container 102. Changing the shape of container 102 may increase the whimsical and festive nature of the postcard. For example, suppose that container 104 is the shape of a martini glass or that the portion of container 14 that is visible from the exterior of postcard 100 takes the form of a martini glass. This, if buoyant glitter/confetti 105 is included in substance 105 with a liquid (e.g., water) and container 104 is shaken then glitter/confetti 105 may resemble ascending bubbles in a martini glass. Thus, the shape of container 104 that is visible to a user increases the functionality of postcard 100 by associating the buoyant confetti/glitter 105 to a non confetti/glitter element (e.g., bubbles). Because of the transparency of container 104, a user could distort any object 109 with such a visual effect, thereby increasing the functionality of postcard 100. Instead of including a transparent container 104, however, a portion of container 104 may be non-transparent such that an image located on this non-transparent portion is distorted in accordance with the special effect instead of, for example, object 109. Persons skilled in the art will appreciate that substance 105 may include two liquids that are insoluble to each other (e.g., one liquid, such as an oil, having nonpolar molecules and one liquid, such as water, having polar molecules) in order to provide a unique special effect. For example, two insoluble liquids could be included in container 104, for example, to realize the special effect similar to that of a lava lamp.

Persons skilled in the art will appreciate that in some countries regulations are imposed on mailable items such as greeting cards and postcards. For example, a country may have a regulation stipulating that any mailed objects containing liquid must be mailed in either an absorbing envelope or watertight container. Such envelopes or containers may be tailored so that the absorption or waterproof/watertight areas are selectively placed on the envelope/container to align with the placement of a visual effects container in accordance with the principles of the present invention. As per another example, some countries may have weight limitations on postcards. If, for example, a postcard in accordance with the principles of the principles of the present invention exceeds the weight limitations of a country, the postcard may be mailed in an envelope like a greeting card of the present invention. Persons skilled in the art will also appreciate that a greeting card, gift bag, postcard, or the like may contain more than one special effects container.

From the foregoing description, persons skilled in the art will recognize that this invention generally relates to the whimsical and festive nature of postcards, greeting cards, and gift bags. In addition, persons skilled in the art will appreciate that the various configurations described herein may be combined without departing from the present invention. It will also be recognized that the invention may take many forms other than those disclosed in this specification. For example, the special effects container in, for example, a special effects container may be attached to an aperture located on a sheet segment by means of an axis (e.g., axis 97 of postcard 90 of FIG. 9). This special effects container may spin on this axis (e.g., like a globe of the earth). A user may spin this special effects container about the axis to produce a visual effect instead of shaking the greeting card. Accordingly, it is emphasized that the invention is not limited to the disclosed assemblies and methods, but is intended to include variations to and modifications therefrom which are within the spirit of the following claims.

What is claimed is:

1. A greeting card comprising:

a first and second sheet segment folded about a first fold line;

an aperture defined in said first sheet segment;

a first containment sheet aligned with said aperture, wherein said first containment sheet is substantially flat and at least a portion of said first containment sheet is transparent;

a second containment portion, separate from said first containment sheet, aligned with said aperture, wherein said first containment sheet and said second containment portion are attached together to form a special effects container and a portion of said special effects container is non-transparent;

a substance located in said special effects container, wherein said substance is viewable through said aperture; and an image located on said second containment portion, wherein said image is viewable through said aperture and said substance is operable to move about said image.

2. The greeting card of claim 1, wherein said first containment sheet is attached to said second containment portion by having said first containment sheet fixed to one side of said first sheet segment and by having said second containment portion fixed to the other side of said first sheet segment.

3. The greeting card of claim 1, wherein said substance includes a glitter.

4. The greeting card of claim 1, wherein said substance includes a confetti.

5. The greeting card of claim 1, wherein said substance includes a liquid.

6. The greeting card of claim 1, wherein said substance includes a liquid and special effect particles.

7. The greeting card of claim 1, wherein said substance includes magnetic filaments.

8. The greeting card of claim 1, wherein said substance includes a first and second liquid that are insoluble to each other.

9. The greeting card of claim 1, wherein said substance includes a first and second liquid that are insoluble to each other and special effect particles.

10. The greeting card of claim 1, wherein said second containment portion is a third sheet segment of said folded sheet folded about a second fold line.

11. The greeting card of claim 1, wherein said substance includes a liquid and special effect particles, wherein said special effect particles have a negative buoyancy with respect to said liquid.

12. The greeting card of claim 1, wherein said substance includes a liquid and special effect particles wherein said special effect particles have a positive buoyancy with respect to said liquid.

13. The greeting card of claim 1, wherein said aperture is substantially circular.

14. The greeting card of claim 1, wherein said aperture is substantially non-circular.

15. The greeting card of claim 14, wherein said substantially non-circular aperture is in the shape of a martini glass.

16. The greeting card of claim 1, wherein said special effects container is operable to be opened and said substance removed.

17. The greeting card of claim 16, wherein said opened special effects container is operable to be re-sealed.

18. The greeting card of claim 1, wherein at least a portion of said special effects container is reflective.

19. The greeting card of claim 18, wherein said reflective portion is a mirror.

20. The greeting card of claim 1, wherein said transparent portion of said first containment sheet is tinted with a color.

21. A greeting card comprising:

a first and second sheet segment folded about a first fold line to form an interior surface of said greeting card and an exterior surface;

a special effects container attached to said first sheet segment on said interior surface, said special effects container comprising:

at least one containment sheet that is substantially flat; and a substance housed in said special effects container, wherein at least a portion of said special effects container is transparent, another portion of said special effects container is non-transparent, and said substance is viewable from said exterior surface through said containment sheet when said greeting card is closed; and an image provided on said special effects container, wherein said substance is operable to move about said image.

22. The greeting card of claim 21, wherein said substance includes special effects particles.

23. The greeting card of claim 21, wherein said substance includes a liquid.

24. The greeting card of claim 21, wherein said substance includes a liquid and special effects particles.

25. The greeting card of claim 24, wherein said special effects particles comprise confetti.

26. The greeting cards of claim 24, wherein said special effects particles comprise glitter.

27. A greeting card comprising:

a non-transparent sheet, wherein said sheet comprises:

a first sheet segment;

a second sheet segment, wherein said first and second sheet segments are separated by a first fold line;

a third sheet segment; wherein said second and third sheet segments are separated by a second fold line;

an aperture defined in said second sheet segment, wherein no aperture is defined in said first sheet segment;

a substantially flat transparent containment sheet affixed to said second sheet segment so that said transparent containment sheet covers said aperture, wherein said first and second sheet segments are affixed together to form a container;

an image located on said first sheet segment, wherein said image is viewable through said aperture; and a substance provided in said container between said image and said transparent sheet.

28. The greeting card of claim 27, wherein said first and second sheet segments are affixed around the perimeter of said second sheet segment.

29. The greeting card of claim 27, wherein said first and second sheet segments are affixed together around the perimeter of said aperture.

30. The greeting card of claim 27, wherein said substance comprises a glitter.

31. The greeting card of claim 27, wherein said substance comprises a confetti.

32. The greeting card of claim 27, wherein said substance comprises a liquid.

33. The greeting card of claim 27, wherein said substance comprises a liquid and special effect particles.

34. The greeting card of claim 27, wherein said substance comprises magnetic filaments.

35. The greeting card of claim 27, wherein said substance comprises a first and second liquid that are insoluble to each other.

36. The greeting card of claim 27, wherein said substance comprises a first and second liquid that are insoluble to each other and special effect particles.

37. A greeting card comprising:

a first and second sheet segment folded about a first fold line;

an aperture defined in said first sheet segment;

a substantially flat first containment sheet aligned with said aperture, wherein at least a portion of said first containment sheet is transparent;

a second containment portion, aligned with said aperture, wherein said first containment sheet and second containment portion are attached together to form a special effects container and at least a portion of said second containment portion is non-transparent;

a substance located in said special effects container, wherein said substance is viewable through said aperture; and an image located on said second containment portion, wherein said image is viewable through said aperture and said substance is operable to move about said image.

38. The greeting card of claim 37, wherein said first containment sheet is attached to said second containment portion by having said first containment sheet fixed to one side of said first sheet segment and by having said second containment portion fixed to the other side of said first sheet segment.

39. The greeting card of claim 37, wherein said substance includes a glitter or confetti.

40. The greeting card of claim 37, wherein said substance includes a liquid.

41. The greeting card of claim 37, wherein said substance includes a liquid and special effect particles.

42. The greeting card of claim 37, wherein said substance includes a first and second liquid that are insoluble to each other.

43. The greeting card of claim 37, wherein said second containment portion is a third sheet segment of said folded sheet folded about a second fold line.

44. The greeting card of claim 43, wherein said first, second, and third sheet segments are non-transparent.

45. The greeting card of claim 43, wherein said third sheet segment includes no aperture.

46. The greeting card of claim 37, wherein all of said second sheet portion is non-transparent.

47. The greeting card of claim 37, wherein said substance includes a liquid and special effect particles, wherein said special effect particles have a negative buoyancy with respect to said liquid.

48. The greeting card of claim 37, wherein said substance includes a liquid and special effect particles wherein said special effect particles have a positive buoyancy with respect to said liquid.

* * * * *